United States Patent [19]

Duske

[11] 4,244,716

[45] Jan. 13, 1981

[54] SKIMMER APPARATUS FOR CENTRIFUGAL SEPARATORS

[75] Inventor: Wilfried P. Duske, Milwaukee, Wis.

[73] Assignee: Progressive Development Inc., Milwaukee, Wis.

[21] Appl. No.: 53,972

[22] Filed: Jul. 2, 1979

[51] Int. Cl.[3] ..... B04C 5/103

[52] U.S. Cl. ..... 55/340; 55/399; 55/451; 55/460; 210/512.1

[58] Field of Search ..... 55/339, 340, 345, 391, 55/399, 392, 415, 451, 452, 454, 460; 210/84, 512 M, 512 R

[56] References Cited

U.S. PATENT DOCUMENTS

| | | | |
|---|---|---|---|
| 3,283,480 | 11/1966 | Szego | 55/392 X |
| 3,343,346 | 9/1967 | Broyard | 55/460 X |
| 3,526,483 | 9/1970 | Deussner et al. | 55/340 X |
| 3,800,429 | 4/1974 | Lindl | 55/415 X |
| 4,163,719 | 8/1979 | Macierwicz et al. | 210/84 |

*Primary Examiner*—John Adee

*Attorney, Agent, or Firm*—Andrus, Sceales, Starke & Sawall

[57] ABSTRACT

A skimmer is secured to the top of a cyclone separator. The skimmer includes an outer cylinder forming an extension of the conventional air exhaust duct of the separator and an inner concentric cylinder terminating within the lower end of the outer cylinder. A specially constructed spiral directing wall means is secured within the space and directs the fine dust laden peripherial layer of the exhaust air through the outer peripheral portion of the exhaust duct for selective discharge into and from a discharge opening and duct means. A door is provided for the opening, and has a central pivot means to simultaneously open and close the reverse sides of the door. The cylinders define an annular space aligned with the peripherial layer of the upwardly moving air from the cyclone separator. The peripherial air layers move into and through the annular space into the discharge duct or back into the center of the center cylinder while the central relative clean air passes through the center cylinder for discharge. In a drying installation the dust laden air may be recycled to a furnace for incineration and/or as a heat carrier.

10 Claims, 5 Drawing Figures

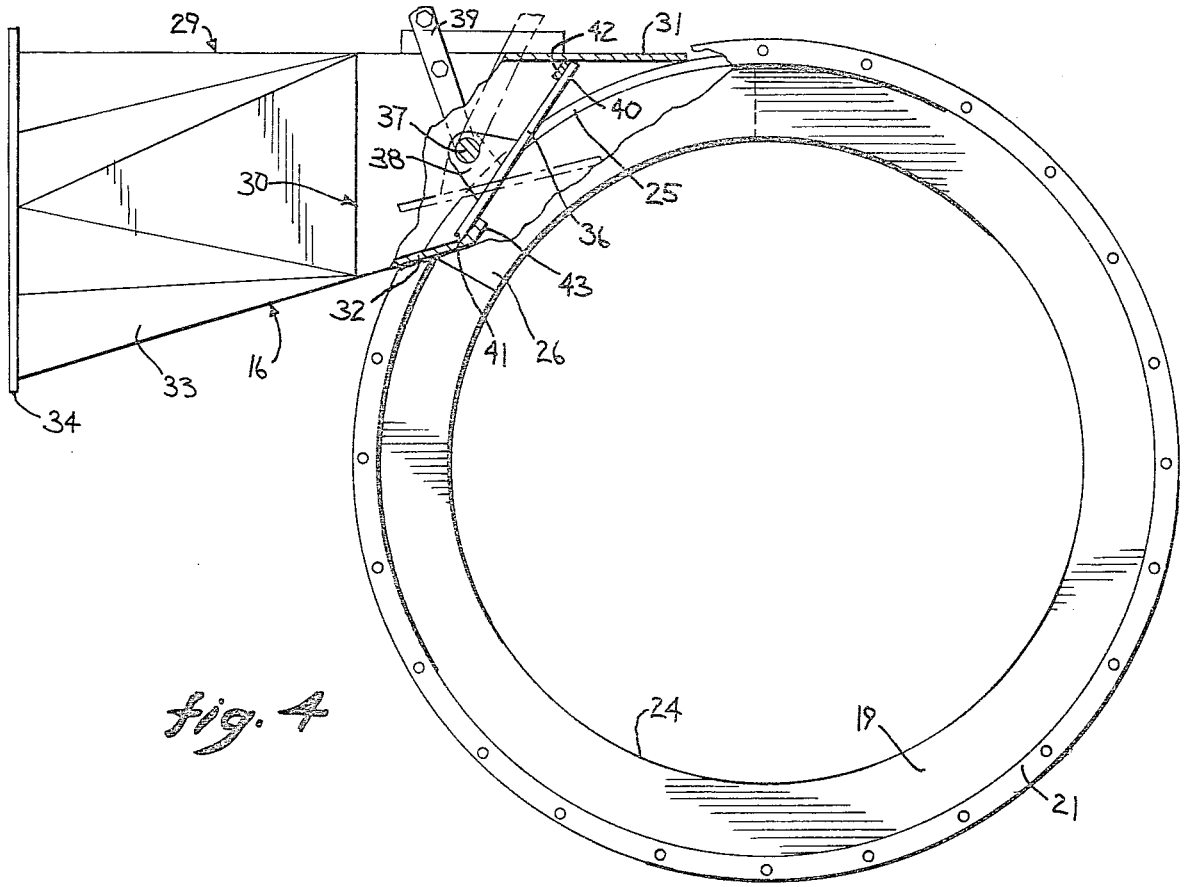
fig. 4
fig. 5
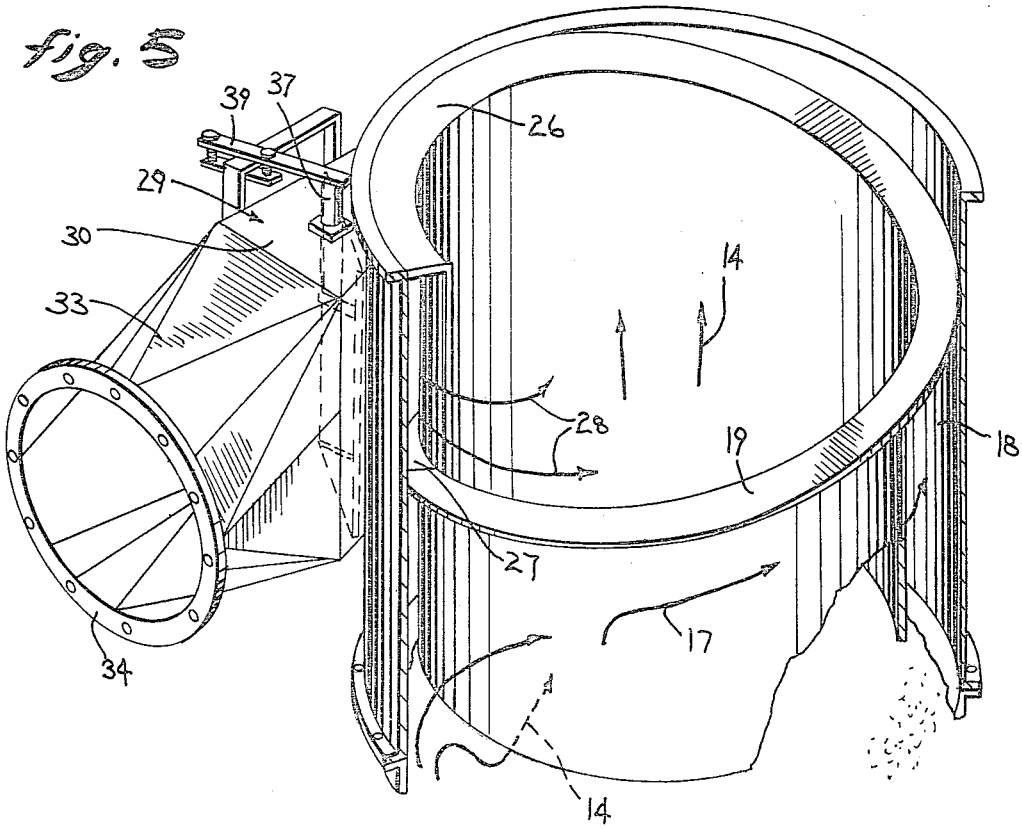

SKIMMER APPARATUS FOR CENTRIFUGAL SEPARATORS

BACKGROUND OF THE INVENTION

This invention relates to a discharge fluid skimmer unit for removal of the fine dust from the discharge fluid of a cyclonic-type particle separator or the like.

Cyclone separators are widely employed in industry for the separation of treated particulate products from a moving or carrier fluid. For example in the drawing of grain, and similar materials, the wet grain is passed through a rotating dehydrating drum by a suitable hot air carrier resulting in the drying of the material. When discharged from the dehydrating drum, the dry material must of course be separated from the air. A cyclonic separator is a well-known apparatus used for separating of such dried products from the air, with recycling or discharge of the air to the atmosphere. In a cyclone separator, the particle laden air is introduced into a top upper circular housing having a bottom conically shaped housing with a bottom discharge opening. The air is introduced tangentially and circulates through the upper housing. An air discharge duct is mounted concentrically of the top housing and terminates within the separator below the inlet opening. The particles tend to concentrate in an outer air layer adjacent the outer wall of the top wall section and drop downwardly into the discharge conical housing of the separator. The carrier air is drawn back upwardly through the central air exhaust tube for recirculation and/or discharge to the atmosphere. For example, in a grain dryer, the exhaust air may be recirculated back to the drying furnace apparatus for appropriate use therein. All of the air cannot be recycled and at least part of the exhaust air must be discharged to the atmosphere or otherwise processed by some other discharge means provided. Although cyclone separators provide satisfactory separation or have been widely employed, the discharged air may carry a substantial quantity of fine particles. Where the total amount or more of the exhaust air is recirculated, a source of undesired pollution may be created. The prior art has suggested that a skimmer assembly employing a further centrifugal action be secured to the top of the cyclone separator to further concentrate the fine particles in the peripheral portion of the skimmer for removal and particularly as the part of recycled air while discharging of exhaust air with a minimum of pollutants.

SUMMARY OF THE PRESENT INVENTION

The present invention is particularly directed to a cyclone type separator and particularly to a skimmer apparatus adapted to be secured to the cyclone separator for efficient and effective removal of fine dust from the exhaust carrier fluid medium. Generally in accordance with the present invention the skimmer apparatus includes a concentration passageway means including a specially constructed spiral directing wall means for directing of the fine dust laden peripherial layers of the exhaust fluid through the outer peripheral portion of the exhaust duct for selective discharge into and from a discharge opening and duct means. The spiral wall means may also function as the support for the inner exhaust duct means. A door or cover member is provided for opening and closing of the discharge opening and duct means. The cover means is preferably mounted with a central pivot means to simultaneously open and close the reverse sides of the cover. The spiral directing wall defines an opening to the center exhaust duct means and allows the air which is not skimmed to fully flow into the exhaust passageway. This prevents creation of a back pressure condition which balances the pressure condition in the cyclone separator. The spiral directing wall also substantially follows the spiral flow direction of the air exhausting from the cyclone separator and thereby minimizes any dust buildup on the spiral directing wall.

More particularly, the skimmer apparatus includes an outer cylindrical member, an extension of the conventional air exhaust duct and an inner cylindrical member defining a relatively narrow annular space encircling the main discharge path of the exhaust air. The air flows upwardly from the cyclone separator in a continuing spiral flow adjacent the exhaust duct and thereby concentrating the dust adjacent the outer cylinder wall. With the skimmer door open, the peripherial air layers move into the annular space with the central relative clean air passing through the discharge opening. Some of the annular peripheral air layer may be pulled down and into the center depending upon the relative resistance of the flow paths and the pressure differentials within the assembly. The annular space includes a spiral confining wall which directs the air upwardly and circumferentially of the annular chamber to the rectangular discharge opening which expands outwardly into a suitable discharge duct. A plate-like door is mounted within the discharge duct immediately outside the opening. The door is pivotally mounted generally intermediate the length of the door and angularly oriented with one edge adjacent the outer wall and extended therefrom in the direction of air flow through the duct. The door may be positioned between closed position preventing discharge of the dust laden air, whereby all of the exhaust air is withdrawn through the normally center exhaust passageway and partially or wholly swung open to open the skimmer passageway to the opposite sides of the door, whereby more or less of the peripherial air layer is discharged through the skimmer discharge duct. The intermediate location of the pivot support provides for convenient and low force operation of the door structure while maintaining effective opening and closing particularly sealing of the opening when so desired.

The skimmer apparatus with the improved annular capture and discharge portion provides a particularly effective and efficient means of skimming fine dust or other particulate from the exhaust and particularly establishing an effective and efficient recycling control.

DESCRIPTION OF ILLUSTRATED DRAWING FIGURES

The drawings furnished herewith illustrates a preferred construction of the present invention in which the above advantages and features are clearly disclosed as well as others which will be readily understood from the following description.

In the drawings:

FIG. 4 is a top plan view of FIG. 3 with parts broken away and sectioned to show certain details of construction; and FIG. 5 is a pictorial or perspective view of an inner spiral scroll member shown in FIG. 2.

DESCRIPTION OF ILLUSTRATED EMBODIMENT

Figure 1:
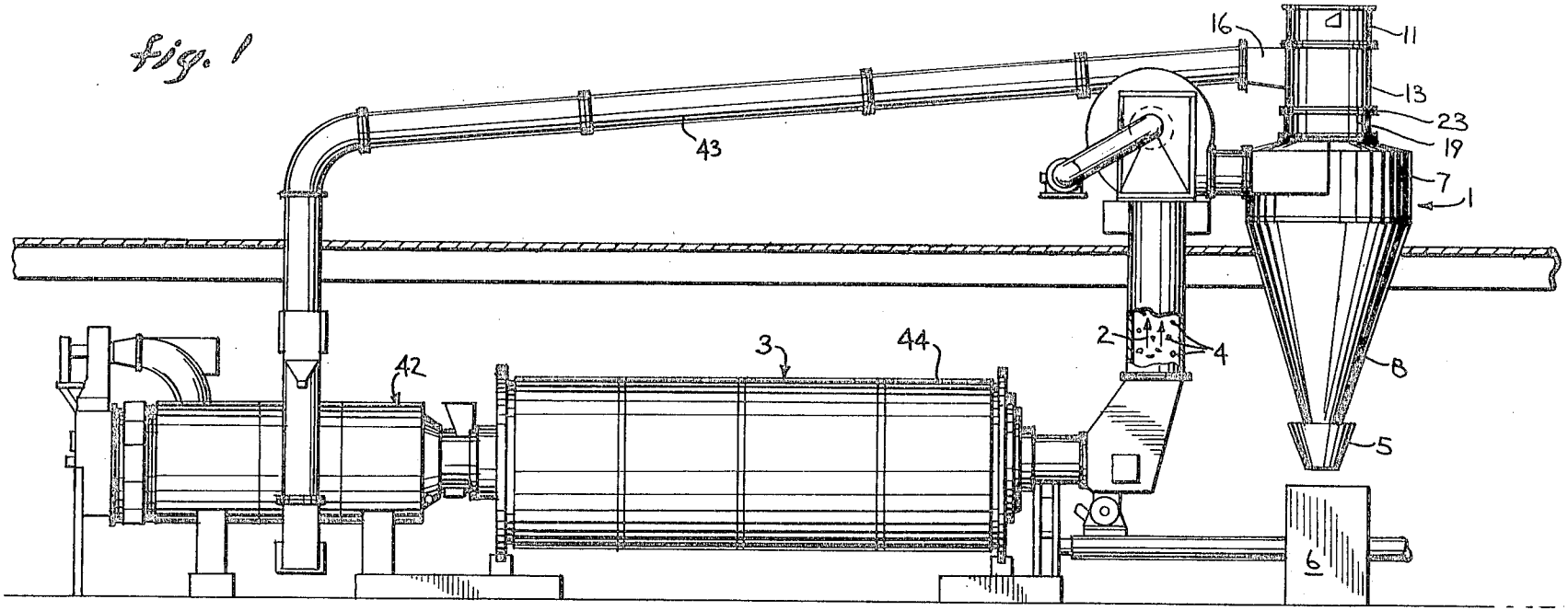
FIG. 1 is a side elevational view of a grain drying apparatus having a cyclone separator incorporating an outlet skimmer unit forming an embodiment of the present invention.
Figure 2:
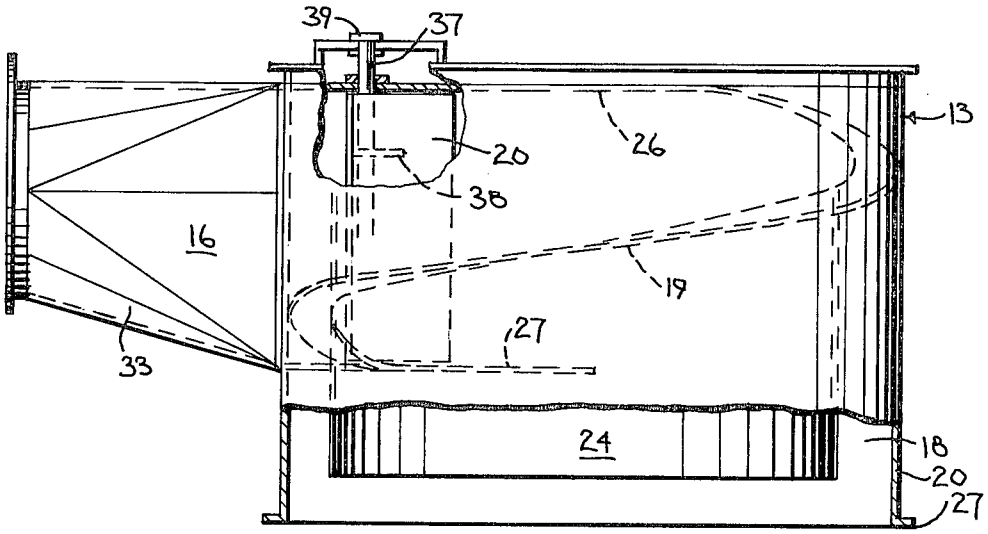
FIG. 2 is a vertical sectional view through the cyclone separator shown in FIG. 1.

A cyclonic separator 1 is shown connected to a source of particulate bearing air 2 such as from grain dehydration equipment 3, shown as a known rotary drier system. The air 2 thus includes a certain amount of dry particulate 4 such as dried grain or other dry matter which is to be separated from the air. The particles 4 are separated from the air within the cyclonic separator 1 and discharged through a bottom outlet 5 and removed by a suitable conveying means 6 or the like.

The cyclonic separator may be of any suitable or known construction. The cyclonic separator generally includes a top vertical cylinder 7 with a conical bottom section 8 terminating at the lower end in the particles discharge opening 5. A central exhaust duct pipe 9 is secured concentrically within the cylinder 6 and extends into the cylinder 7 and often into the upper portion of the bottom cove section 8. A fan means not shown is coupled to the inlet on to the exhaust duct 9 and serves to move the air through the separator. The air at the bottom of cylinder or duct 9 moves upwardly and outwardly through the upper end of duct 9, and in accordance with this invention, through a skimming apparatus 13 forming an embodiment of the present invention. The exiting air 14 may contain fine particles 15 and/or some portion of the particles supplied to the separator as a result of incomplete separation. The skimmer apparatus 13 provides a means for further separating of such fine particles from the exiting air and discharging thereof through a separate peripherial outlet means 16 for further processing or the like.

Thus, the exiting air moves with a continuous spiral motion and tends to concentrate the fine dust in the outer peripheral layer 17 of the exiting outlet duct 9. In accordance with the teaching of the present invention, the skimmer apparatus 13 is constructed to sever such dust concentrated exiting air layer 17 for selective removal and recycling, subsequent processing or the like. As cyclone separators are well-known, no further description is thereof given other than to clearly describe the functioning and operation of the present invention which particularly resides in the skimmer apparatus 13.

Cyclone separators are generally known to be particularly effective on relatively large dust and/or liquid particles. It is known that a portion of the exiting air will therefore contain certain quantities of fine dust depending upon the original quantity. Such fine dust in the exhaust air may not be acceptable and it is suggested for example that in a dehydration system at least a portion of the dust laden air be returned and recycled to a gas fired furnace. The return air is used as the combustion air in the gas fired burner such that the dust particles are burned for further cleansing of the air or the like. The skimmer apparatus of this invention permits the effective and efficient removal of the dust in the exiting air.

Generally in accordance with the illustrated embodiment of this invention, the skimmer apparatus 13 includes a multiple wall assembly defining an outer annular chamber or passageway 18 aligned with the upwardly moving dust laden peripheral air layer 17 of the exiting air 14. A spiral wall member 19, following substantially the flow path of the air is located within the annular passageway 18 and directs the dust laden air 17 upwardly to the skimmer outlet unit 16, and continues past such unit 16 for discharging of the air layer 17 back into the central exhaust air 14 with door unit 20 closed. Thus, door unit 20 is especially mounted within the outlet means 16 to selectively close and open thereof for controlled exiting of the dust laden air and selective recycling of the dust laden air. The special spiral wall 19 thus prevents creation of a back pressure within the cyclone separator which could create undesirable unbalanced pressure conditions and prevent effective particle separation.

More particularly, in the illustrated embodiment of the invention, the skimmer apparatus 13 includes a cylindrical outer wall 21 having a bottom flange 22 for releasable bolting thereof to the top wall of the cyclonic separator unit as at 23 with an airtight joint therebetween. The inner diameter of the outer cylinder 21 is essentially of the same diameter as the outlet pipe 9 and forms a smooth, continuous vertical extension thereof.

An inner cylinder member 24 is secured concentrically within the outer wall 21 to define the annular chamber 18 within the skimmer apparatus with an open bottom end aligned with the dust laden air layer 17. The wall 19 is secured as by welding to the inner and outer cylinders 21 and 24 and forms a fluid tight connection therebetween and also functions to support the inner cylinder 24. The outlet unit 16 includes a generally rectangular opening 25 formed in the outer cylinder 21 for exiting of the air layer 17 from the chamber 18. The spiral closure wall 19 is located within the annular chamber 18, and in the illustrated preferred structure includes a single partial convolution terminating in the opposite ends in flat top and bottom walls 26 and 27 aligned with the top and bottom edges of opening 25. Thus one flat end of wall 19 is secured in the lower end of the chamber adjacent the bottom end of the discharge opening 25. The wall 19 wraps around the wall 21 and upwardly to the opposite upper or top flat end of the opening 25. Thus, the dust laden air layer 17 which is moving in a tangential manner within the cyclone discharge pipe 9 and the outer cylinder 21 is effectively and efficiently directed upwardly toward the opening 25 for discharge through opening 25 and discharge unit 16. If opening 25 is wholly or partially closed, the dust laden air layer 17 may exit into the central portion of the cylinder 24 for discharge with the clean air at the end of the spiral wall, as shown most clearly at 28 in FIGS. 5 and 4. The essentially dust-free central air of course moves upwardly through the inner cylinder 24 for discharge through a fan unit 10 in accordance with conventional practice.

Figure 3:
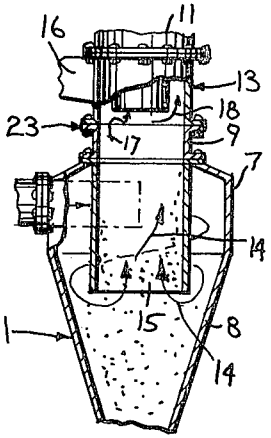
FIG. 3 is an enlarged side elevational view of the skimmer unit shown in FIGS. 1 and 2.

The skimmed air layer 17 is conveyed from the skimmer apparatus 13 through the outlet unit 16 which preferably includes a discharge duct 29 secured to the outer cylinder 21. The outlet duct 29 includes a generally rectangular section 30 secured to the outer cylinder 21 and forming an extension of the discharge opening 25. The rectangular section 30 includes flat horizontal top and bottom walls which extend outwardly from the outer cylinder opening. As shown in FIG. 3, the outermost duct sidewall 31 of the rectangular section 30 is substantially tangential to outer cylinder 21 at the leading end of the discharge opening 25. The opposite sidewall 32 is secured to the opposite opening edge and extends outwardly and circumferentially outwardly in the direction of motion to form a progressively increasing opening for the discharge of the skimmed air. A connecting duct 33 is connected to the rectangular section 30 and changes to a cylindrical duct with an outer flange 34 for coupling to conventional recycling duct work or the like. The door unit 20 includes a rectangular plate-like door or cover 36 pivotally mounted within the rectangular section 30. The door 36 has depth slightly less the depth of the duct section 30. A pivot shaft 37 is secured within the rectangular duct section 30 immediately behind the door 36. The shaft 37 extends vertically through the duct and is journaled in the opposite top and bottom walls thereof. The door 36 is fixedly attached to the pivot shaft as by connecting brackets 38 secured to the backside of the door. The outer end of the shaft 37 is provided with an operating handle or bar 39 for manual or powered appropriate pivoting of the door between a closed and partially or wholly opened position. The door 36 is longer than the width of the duct section 30 and is angularly oriented within the rectangular duct section 30. The door 36 has a forward edge 40 located adjacent to the outermost tangential duct wall 31 and extends outwardly therefrom generally along the projection of the outer circumference of the cylinder wall 21 through the trailing or opposite edge of opening 25 to locate the opposite edge 41 at the short sidewall 32 adjacent to such opposite edge of opening 25. Suitable closure stop members 42 and 43 are provided on the duct walls adjacent the opposite ends of the door edges. The stops 42 and 43 are secured to the opposite sides of the cover or door. Thus, the door 36 may be pivoted to the closed position engaging the stops to essentially seal the skimmer discharge opening 25 as shown in full line illustration in FIG. 3. The pivot shaft 37 is located intermediate the length of the door 36 which thus pivots to selectively locate the forward closure edge 40 and the rearward closure edge 41 of the door in the closed position or an open position, as shown in phantom in FIG. 4. Pivoting of the handle 39 in the clockwise direction, as viewed in FIG. 4, pivots the door 36 from the closed position around pivot shaft 37 with the forward edge 40 of the door moving into the opening 25 and the rearward edge 41 moves outwardly from the duct sidewall 32 to permit the air to flow from the annular chamber 18 into the discharge unit 16. In the fully open position, the forward edge 40 moves into engagement with the inner cylinder wall 24 to close off the passageway 18 and positively divert all of the skimmed dust laden air layer 17 from the skimmer apparatus 13 into the exhaust duct unit 16 for recycling or the like. The door can of course be placed in an intermediate position in which a portion of the air is positively diverted into the duct work while exposing and allowing certain amounts of flow around the backside of the door.

The skimmed air layer may thus be recycled in the illustrated embodiment to the dehydrating equipment 3 via a return duct 43. The furnace 42 is of course coupled to the rotary drier 44 to establish a flow of hot air through drier 44 for drying of the moisture grain or other particulate in accordance with well-known drier systems.

The illustrated preferred embodiment provides a highly effective means of removing fine dust as well as other matter entrained in the exiting fluid of the cyclone generator or any other type of a centrifugal separator in which the exiting air moves with a centrifugal action to an outlet means. Various modifications may be made to the illustrated structure within the basic concept of providing a controlled annular exiting passageway in combination with the control directional wall for closing of the annular passageway and providing optimum directional movement of the dust laden air into the skimmer discharge opening or back into the exhausting air from the cyclone separator.

Various modes in carrying out the invention are contemplated as being within the scope of the following claims, particularly pointing out and distinctly claiming the subject matter which is regarded as the invention.

I claim:

1. A skimmer apparatus for use with a centrifugal flow means in which fluid borne particulate is concentrated in the outer periphery of the fluid, said peripherial air containing particulate, the improvement in said skimmer apparatus for removing said retained particulate from said fluid comprising a means establishing an annular passageway aligned with the periphery of the exiting air and having a peripherial discharge opening, said means comprising an outer cylinder means connected to and spaced from an inner cylinder means, a spiral wall strip having first and second edges located with the annular passageway with one of said strip edges secured to said outer cylinder and the other of said strip edges secured to said inner cylinder means for directing of the outer portion of the air to said peripherial discharge opening and back to the center of the skimmer and means to selectively proportion the air, directly enter the opening and back to the center of the skimmer.

2. The skimmer apparatus of claim 1 wherein said means includes a door means mounted to variably open and close said peripherial discharge opening.

3. A skimmer apparatus for use with a centrifugal separator having inlet means to establish a tangentially moving fluid flow path for concentration of fluid borne particulate adjacent the outer periphery of the separator and an air outlet means mounted coaxially within said flow path and having means to draw exiting air from the center of the path, said exiting air containing relatively small quantities of particulate, the improvement in said skimmer apparatus for removing said retained particulate, the improvement in said skimmer apparatus for removing said retained particulate from said exiting air comprising a passageway having an outer cylinder means serially connected to said outlet means and an inner cylinder means concentric of said first cylinder means and defining an annular passageway, said outer cylinder means having a discharge opening and a spiral wall strip having first and second edges secured within said annular passageway with one of said edges connected to said inner cylinder means and the other of said edges connected to said outer cylinder means for directing the outer portion of the exiting air to said discharge opening and back to the inner cylinder.

4. The skimmer apparatus of claim 3 having a cover means mounted to variably open and close said portion of the exiting air to said discharge opening.

5. The skimmer apparatus of claim 3 wherein said inclined wall means is a continuous spiral wall sealing the passageway between said cylinder means and directed substantially along the path of the air in said annular passageway.

6. A skimmer apparatus adapted to be releasably attached to the top of a cyclone separator having a tubular top portion and a conical bottom portion with an air inlet means adjacent the upper end of the top portion to establish a spiral flow path downwardly through the separator and having a bottom particulate outlet and a top air outlet means located concentrically of flow path and having means for establishing a suction pressure in said air outlet means, said skimmer apparatus comprising an outer cylinder wall having mounting means for attachment to said cyclone separator and forming an extension of said air outlet means, said cylinder wall having a sidewall opening for discharge of air, a discharge duct means secured to the opening in said outer wall means, and extending substantially tangentially of said wall means, an inner cylinder wall mounted in concentric spaced relation to said outer cylinder wall with the low end spaced upwardly of the outer cylinder wall and forming a relatively small annular spacement therebetween relative to the diameter of said walls, a spiral horizontal wall means secured to the opposing faces of said outer and inner walls and extending from the bottom of the opening to the top of opening to direct the air within said annular spacement into said discharge opening, and a cover means pivotally mounted within said duct means to vary the effective size of the discharge opening.

7. The skimmer apparatus of claim 6 wherein said discharge opening is a rectangular opening having an axial depth substantial in excess of the circumferential width.

8. The skimmer apparatus of claim 7 wherein said discharge duct means includes a rectangular section secured to the wall means to form an extension of said discharge opening, said cover means including a rectangular plate-like member mounted within said section and angularly oriented in the direction of flow with a forward edge adjacent the opening and rearward edge spaced outwardly within the duct means and having a pivot support secured to the plate-like member intermediate said edges for pivoting of the plate-like member from a first position opening said discharge opening to both sides of said plate-like member.

9. The skimmer apparatus of claim 8 wherein said cover means includes side wall stops secured to said discharge duct means and engaged by the opposite sides of the plate-like member in the closed position, and said pivot mount being offset toward the rearward edge of the cover means.

10. A skimmer apparatus for use with a centrifugal tangential flow means in which fluid borne particulate is concentrate in the outer periphery of the fluid, the improvement in said skimmer apparatus for removing said retained particulate from said air comprising a pair of concentric wall means establishing an annular passageway, aligned with the peripherial air, a spiral wall strip disposed within said annular passsageway and connected to said concentric walls, the outer wall means has a discharge opening, means to selectively open and close the discharge opening, and the inner wall means has a relief opening located immediately downstream from the discharge opening in the direction of the tangential air flow.

* * * * *